United States Patent [19]

Greenough

[11] Patent Number: 4,917,026

[45] Date of Patent: Apr. 17, 1990

[54] DEBRIS BURNER

[75] Inventor: Ronald L. Greenough, Surrey, Canada

[73] Assignee: MacMillan Bloedal Limited

[21] Appl. No.: 329,512

[22] Filed: Mar. 28, 1989

[51] Int. Cl.[4] ..... F23L 15/00

[52] U.S. Cl. ..... 110/297; 110/346; 110/348

[58] Field of Search ..... 431/178, 179, 180; 110/245, 297, 346, 314, 348

[56] References Cited

U.S. PATENT DOCUMENTS 3,785,302 1/1974 Davis .
4,744,312 5/1988 Narisoko et al. ..... 110/245

FOREIGN PATENT DOCUMENTS 1013619 7/1979 Canada .
1080038 6/1980 Canada .
0142415 9/1982 Japan ..... 110/297

*Primary Examiner*—Edward G. Favors

[57] ABSTRACT

An incinerator, comprises a combustion chamber having a pair of opposed side walls and a top outlet passage. Primary air is injected into the combustion chamber through the floor and air jets located in each side wall adjacent the outlet passage direct air streams across the chamber above the material being burned. The air jets on one of side walls are longitudinally offset relative to the air jets on the other side wall along the length of the chamber so that the air streams traversing the chamber from one side wall do not directly interfere (except at their outer peripheries) with the air streams from the other side wall and the air streams as they approach the side walls are directed downward toward the bottom of the chamber and tend to flow into and upwards along the surface material being burned.

3 Claims, 2 Drawing Sheets

DEBRIS BURNER

FIELD OF THE INVENTION

The present invention relates to an incinerator, more particularly the present invention relates to a debris incinerator for burning debris having widely varying moisture contents and sizes.

BACKGROUND OF THE PRESENT INVENTION

The disposal of non-merchantable debris which accumulates in the processing of logs, in a manner which is environmentally acceptable is becoming increasingly costly. The traditional incineration of the material in an open field fire is not satisfactory where residential townsites have developed in proximity to log yards. Burying is expensive and suitable burial site availability has been significantly reduced. Conventional incinerators require that the fuel size be small and uniform yet log yard waste is in sizes from small pieces up to full logs. The cost of reducing this waste material to usable fuel sizes has rendered the use of conventional incinerator types non-economic. Simple pit incinerators have been successful where dry ambient conditions result in a relatively moisture free debris.

Incineration of debris, particularly forest residue, requires a burner capable of receiving as fuel log sections as big as several feet in diameter and up to about thirty feet in length together with small branches and having a moisture content varying from a few percent to well over 100% and to burning this variable mixture at emission levels acceptable to a residential area.

Canadian Patent No. 1,013,619 issued July 12, 1977 to Weholt discloses a portable unit for burning debris. In this system an open top outwardly flaring combustion chamber having means for applying under fire air at the bottom of the chamber and air curtains across the outlet from the chamber formed by opposed interfacing jets at the top of the flaring side wall. These curtains are directed to intersect each other about midway across the chamber and inhibit the escape of material from the chamber before being completely combusted.

The intersecting air curtains utilized in this system produces counter rotating inter mixing currents within the chamber in the area of a second combustion zone (above the burning debris and immediately below the air curtain) in an attempt to ensure substantially complete combustion of debris within the combustion chamber.

U.S. Pat. No. 3,785,302 issued Jan. 15, 1974 to Davis corresponding Canadian patents 1,024,398 and 1,030,001) discloses a device similar to that described in the Weholt patent and includes means for providing both combustion air and supplementary fuel under pressure through the bottom wall and utilizes interfering air jets from the opposite side walls and directed into the chamber at different angles to form air curtains impeding movement of gases and other material from the combustion zone in a manner similar to the Weholt patent. In Davis the jets may be moveable or rotatable about a horizontal axis on the side walls to change the angle of impact of the air curtains.

Canadian Patent No. 1,080,038 issued June 24, 1980 to Applegate discloses a blower assembly for applying an overhead air curtain to a pit burner for burning debris. The pit is the combustion chamber and a portable blower applies an overhead air curtain that directs air from one side across the open top of the pit and deflected downward off the opposite wall into the pile of burning debris to provide all the combustion air for the debris.

BRIEF DESCRIPTION OF THE PRESENT INVENTION

It is an object of the present invention to provide an improved debris burner particularly suitable for burning forest waste material and capable of limiting emissions therefrom.

Broadly the present invention relates to an incinerator comprising an incinerating chamber having a floor and a pair of opposed side walls extending from said floor to a top outlet opening, means for injecting primary air through said floor, a first air jet means on one of said walls adjacent said outlet opening, said first air jet means directing first streams of air from said one side wall across said chamber toward the other of said pair of side walls, a second air jet means on said other wall adjacent said outlet opening, said second air jet means directing second stream of air from said other side wall across said chamber toward said one wall, said first and second air jet means each comprising a plurality of air jet outlets spaced along the axial length of its respective of said side walls, said air outlets of said first air jet means positioned longitudinally intermediate said air jet outlets of said second air jet means along the length of said side walls so that at least a portion of said first and second streams of air tend to traverse said chamber without substantial direct interference by said second and first air stream respectively.

Preferably said air outlets of said first and second air jet means are directed so that said first and second air streams after traversing said chamber are deflected down the back of the wall toward said floor and into and upward along the adjacent side of burning debris zone in said chamber.

Preferably said air jet outlet in each of said air jet means are arranged in rows extending longitudinally of said chamber and adjacent said outlet opening.

Preferably said opposed walls of said incineration chamber are sloped so that they are closer together at said top outlet opening and said top outlet opening has an area significantly smaller than the area of said floor.

The opposed side walls are spaced wider than said debris burning zone in said incineration chamber during normal operation of the incinerator to provide a space for said air streams deflected to flow downward toward said floor and turned floor to enter said burning zone pile and to flow upward over the adjacent side of said fuel zone.

Said side walls are spaced so that debris dropped through said top outlet opening into said burning zone falls clear of the inward sloping side walls. A layer of ash is formed between said fuel pile or burning zone and each of said side walls to form a protective cushion to protect the walls from the impact of debris rolling down the face of the pile (debris pile) or (fuel Pile).

The present invention also relates to a method of burning debris which comprises containing the burning debris within a burning zone within an incineration chamber having a top outlet, a floor and a pair of opposed side walls, passing a plurality of first air streams from one of side walls across said chamber above said burning debris toward the other of said side walls above said burning debris and passing a second plurality of air streams from said other across said chamber above said burning debris to said one side wall said air streams being spaced along the length of said chamber and said first and second air streams alternating along said length and combining to impede flow of gases from said chamber through said top outlet.

Preferably said first and second air streams are deflected along said side wall toward said floor and are redirected toward said burning debris to heat said air streams and to ignite any volatiles contained therein.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
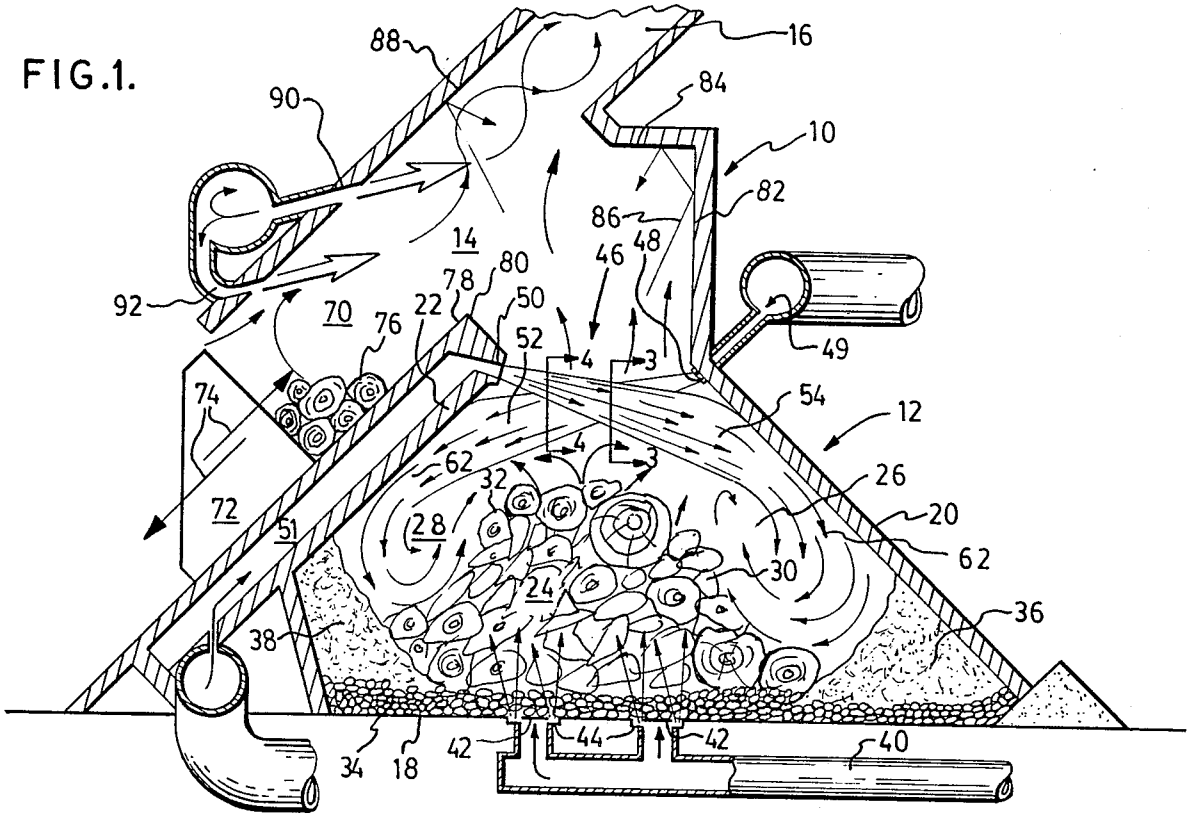
FIG. 1 is a schematic cross section of a refuse burner constructed in accordance with the present invention.

The incinerator 10 of the present invention has a combustion chamber 12, a debris inlet compartment 14 and a flue gas outlet 16.

The combustion chamber 12 has a floor 18 and a pair of opposed side walls 20 and 22. The walls 20 and 22 are lined with suitable ceramic material to reflect heat back into a burning zone 24 containing a burning pile of debris 24 and maintain a high temperature in the chamber 12.

The fuel pile or burning zone 24 defined by the pile of debris being burned is significantly smaller than the chamber 12 and will normally have sides 30 and 32 sloping at the angle of repose for the debris being burned. The side walls 20 and 22 slope at an angle similar to the angle of repose of the pile in the zone 24 so that the spaces 26 and 28 provided between the side faces 30 and 32 of the pile in zone 24 and the walls 20 and 22 respectively are substantially the same width along the height of the zone 24.

In the illustrated arrangement a bed of gravel or the like 34 is provided on the bottom or floor 18 to protect the floor and facilitate mechanical ash removal. The ash formed by burning the debris in zone 24 accumulates on the gravel bed 34 and is distributed by the air circulation and the impact of debris falling into the zone 24 to form piles 36 and 38 that tend to protect the walls 20 and 22.

Under fire air is injected into the bottom of the debris pile or zone 24 via the piping as indicated at 40 and grates formed by plates 42 suspended in trenches 44 below the level of floor 18 and blows up through the gravel layer 34 into the pile of debris 24 to provide a source of primary air.

The upper ends of the walls 20 and 22 of the chamber 12 define a top outlet opening 46 leading to the inlet compartment 14. The area of outlet opening 46 preferably will be about $\frac{1}{4}$ to $\frac{1}{2}$ the area of the floor 18.

Immediately below the outlet opening 32 in each of the side walls 20 and 22 there are provided gas jet outlets 48 and 50 for directing streams of air 52 and 54 respectively across the chamber 12.

The required quantities of air are supplied to the jet outlets 48 and 50 via suitable ducting as indicated at 49 and 51 respectively.

Figure 2:
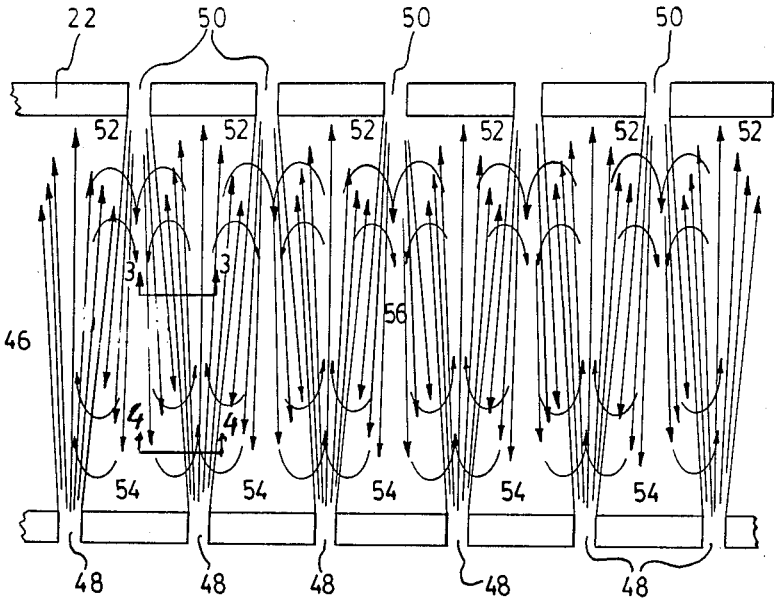
FIG. 2 is a section along the line 2—2 in FIG. 1 illustrating the inner action of the alternative counter directed jets sweeping the outlet from the incinerating chamber.

As can be seen in FIG. 2, there are a plurality of air jet outlets 48 and 50 on each of the walls 20 and 22 with the outlets 48 and 50 alternating along the longitudinal length of the outlet 46 or chamber 12 so that the air streams 52 and 54 from the jets 48 and 50 respectively alternate over the longitudinal length of the chamber 12 and do not tend to interfere with each other at least over a major portion of their areas. Each of these streams of air 52 form conical or fan shaped (divergent) configuration increasing in cross sectional area with distance from the jet outlet 48 illustrated and similarly each of the streams of air 54 are similar fan shaped air flows expanding in cross sectional area with distance from the jet outlets 50. It will be apparent that the side edge of these fan shaped, flaring or expanding air streams 52 and 54 will interfere along their adjacent peripheries as they traverse the chamber 12 flowing in opposite directions which results in eddy flows substantially as schematically indicated for example at 56 in FIG. 2.

These streams of air 52 and 54 passing across the opening 32 well above the debris burning zone 24 and tend to impede the escape of combustion gases from the chamber 12 into the inlet chamber 14 and cause them to be carried to the base of the fire or fuel pile or burning zone 24 as will be described below.

Figure 3:
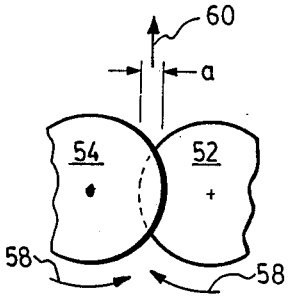
FIG. 3 is a cross section along the lines 3—3 shown in FIGS. 1 and 2 illustrating different air stream cross sections.
Figure 4:
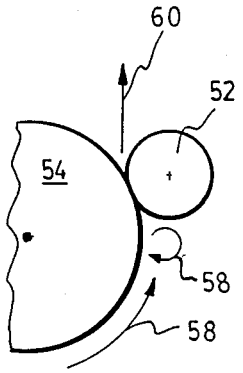
FIGS. 4 is a section similar to section 3 but taken along the lines 4—4 of FIGS. 1 and 2.

FIGS. 3 and 4 illustrate schematically air streams 52 and 54 that are substantially circular in cross section. It can be seen that substantially half way across the outlet opening 46 between the walls 20 and 22 as indicated in FIG. 3 the two air streams 52 and 54 (the stream 52 tending flow into the paper and the stream 54 out of the paper) tend to overlap along their side edges as indicated by the dimension a. Obviously this area represented by the dimension a will be an area of eddy currents and turbulence as schematically indicated at 56 in FIG. 2. The arrows 58 and 60 schematically represent gas escaping from the chamber 12 into the areas of turbulent mixing between the adjacent air streams.

It will be noted that the cross section of the air stream 54 in FIG. 4 is significantly larger than that of the air stream 52 since section 4—4 is closer to the outlet 48 from which the air stream 52 issues and the air stream 52 has not had the opportunity to expand as much as the air stream 54.

It is preferred to use substantially round jets and thus air streams will have more or less circular cross sections which facilitate flow of these streams across the full width of the outlet opening 46. However air streams of different cross sections may be used if desired for example rectangular with the major lengths parallel to the floor 18.

The air streams 52 and 54 as shown in FIG. 1 tend to impinge on the side walls 20 and 22 preferably at a position just below the level of jet outlets 48 or 50 on the opposite wall. The air streams 52 are positioned between the stream 54 and are directed toward the wall 22 between the outlets 50 and the floor 18 (normally close to the outlets 52) and similarly the air streams 54 are between the streams 52 and are directed toward the wall 20 between the air outlets 48 and the floor 18.

As illustrated in FIG. 1 the air streams 52 and 54 approach the walls 22 and 20 respectively at acute angles so that the air in each of these streams 52 and 54 is deflected downwardly as indicated by the arrows 62 into the spaces 28 and 26 respectively and is further deflected by the ash piles 38 and 36 to flow each into the debris 24 and upward toward the outlet passage 46 along the faces 32 and 30 respectively of the burning fuel pile 24.

This flow of the gases across the opening 46 tends to sweep gases issuing from the zone 24 laterally toward the walls 20 and 22 and then the air streamd containing incompletely consumed gases and particulate are directed down in sweeping relation with the walls 20 and 22, then in toward the zone 24 and upwardly along the sides 30 and 32 of the debris 24 thereby to insure that the air streams carrying non-combusted volatile gases and particulate are heated and directed to the bottom or the hottest part of the fuel pile or burning zone 24 to better insure auto-ignition of the volatiles and thus substantially complete combustion within the combustion chamber 12. Also these flows tend to direct surplus air and volatiles into the zone 24 adjacent the base and thereby to supplement the primary air entering from pipe 30.

The air streams 52 and 54 are always passed above the debris 24. If the pile becomes too high the incinerator must be shut down and the ash must be removed. Similarly, if the spaces 26 and 28 become too small the ash must be removed.

The inlet compartment 14 has a debris inlet passage 70 with a ram 72 moveable as indicated by the arrows 74 along the upwardly inclined passage 70 to deliver debris as schematically illustrated at 76 up the inclined upper surface 78 of the wall 22 so that the debris tumbles over the edge 80 at the top wall 22 and falls through the opening 46, onto the burning debris 24. The ram 56 closes the inlet passage 70 when debris is being dumped into the chamber 12.

The inlet compartment or chamber 14 has a substantially vertical rear wall 82 and a substantially horizontal top wall 84 so that radiant energy leaving the chamber 12 through outlet opening 46 is reflected from the wall 82 and wall 84, back into the chamber 12 as indicated schematically by the ray 86.

The opposed wall of the compartment 14 is an inclined roof 88 that tends to reflect radiant energy leaving the chamber 12 as indicated schematically by the ray 88 and direct this energy back toward the chamber 12.

To facilitate this reflection of energy the insides of the walls 68 and 70 and roof 88 may be lined with suitable ceramics.

Suitable sets of air jet outlets 90 and 92, arranged in axial rows along the roof 88 are preferably provided and are aimed to redirect any flue gases emanating from the chamber 12 away from the inlet 70 and up through the sloping outlet passage 16 formed at the top of the sloping roof 88.

In operation the ram 72 is retracted to its lowest most position, debris is dropped in front of the ram 72 as indicated at 76 and then the ram 72 is moved up the wall 78 and pushes the debris 76 through passage 70 until the debris drops over the edge 80 and form a pile in the burning zone 24 within the chamber 12. During the stoking process the back of the ram closes of the stoking entrance to help prevent the release of smoke and ash during the loading of fresh fuel. To initially ignite the debris a suitable fuel may be added to the debris. Under fire air is injected into the debris pile 24 through the air inlets 40 in the floor 18. The air streams 52 and 54 from the jet outlets 48 and 50 tend to impede the flow of gas through the outlet opening 46 and into the compartment 14. These air streams 52 and 54 approach the walls 22 and 20 respectively are deflected and sweep down the walls tending to cool these walls which become quite hot and are made of a suitable material to reflect the radiant energy to help maintain the very hot conditions within the chamber 12. The deflected air streams 50 and 52 flowing down the walls 20 and 22 toward the floor 18 are then turned inward toward the zone 24 to flow into the zone 24 and upward along the sides 30 and 32 of the burning zone 24. Volatiles which are entrained in their streams adjacent the outlet 46 are carried over or through the hottest part of the burning debris 24 which better insures ignition and burning of the fuel within the chamber 12 so that the majority of the energy available from burning the debris is released within the chamber 12 and is available to dry the wet debris entering the chamber 12.

The air streams 50 and 52 also provide oxygen for burning any debris or volatiles entrained in the flue gases.

As above indicated, most of the energy released by combustion is contained in chamber 12 and radiant energy passing out through the outlet 46 is reflected by the roof 88 or the walls 82 and 84 respectively back into the chamber 12 to be available to dry the wet mass.

Flue gases leaving the chamber 12 and entering the compartment 14 are effected by the further air added through the jets 90 and 92 which induces air flow in through the inlet passage 70 to impede the escape of flue gases through the passage 70 and tend to move the flue gases into the passage 16.

Having described the invention, the modification will be evident to those skilled in the art without departing from the spirit of the invention as defined in the appended claims.

I claim:

1. An incinerator comprising incinerating chamber having a floor and a pair of opposite side walls, a top outlet opening between said walls, means for injecting primary air through said floor, a first air jet means on one of said side walls adjacent said top outlet opening, said first air jet means directing a plurality of first streams of air from said one side wall across said chamber toward the other of said pair of side walls, a second air jet means on said other wall adjacent said outlet opening, said second jet means directing a plurality of second streams of air from said other side wall across said chamber toward said one side wall, said first and second air jet means each comprising a plurality of air jet outlets, each said air jet outlet being a source of one of said air streams, said air jet outlets of each of said air jet means being spaced along the axial length of its respective of said side walls with said air jet outlets of said first jet means positioned longitudinally intermediate said air jet outlets of said second jet means along the length of said chamber so that at least a major portion of each of said first and second streams of air traverse said chamber without substantial direct interference by said second and said first air streams respectively and wherein said air jet outlets are directed across and downward into said chamber in a manner so that said first and second streams of air as they approach each other and said one wall respectively are deflected toward said floor and into spaces between said side walls and a burning zone within said chamber and spaced from said one and said other walls.

2. An incinerator as defined in claim 1 wherein said air jet outlets in each of said air jet means are arranged in rows extending longitudinally of said chamber and adjacent said outlet opening.

3. A method of burning debris in a burning zone within an incineration chamber having a top outlet, a floor and a pair of opposed side walls, said burning zone being positioned between and spaced from each of said pair of opposed side walls comprising passing a plurality of first air streams from said one side wall across said chamber above said burning zone toward said other side wall and passing a second plurality of air streams from said other side wall across said chamber above said burning zone toward said one side wall said air streams being spaced along the length of said chamber and said first and said second air streams alternating along said length and combining to impede flow of gases from said chamber through said top outlet, passing said air streams across said chamber above said burning zone to entrain volatiles liberated from said burning debris, directing said streams along said other and said one wall respectively toward said floor in spaces between said other and said one wall and their adjacent sides of said burning zone and then redirecting said air streams toward said burning zone adjacent said floor and passing said air stream upwardly along said sides of said burning zone to facilitate ignition of volatile gases carried in said air streams.

* * * * *